US012662909B1

(12) United States Patent
Gunasekaran et al.

(10) Patent No.: US 12,662,909 B1
(45) Date of Patent: Jun. 23, 2026

(54) COLLAPSABLE COLLET EXIT WHIPSTOCK

(71) Applicant: Halliburton Energy Services, Inc., Houston, TX (US)

(72) Inventors: Mohan Gunasekaran, Al-Khobar (SA); Mark Glaser, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/271,151

(22) Filed: Jul. 16, 2025

Related U.S. Application Data

(60) Provisional application No. 63/766,894, filed on Mar. 4, 2025.

(51) Int. Cl.
*E21B 41/00* (2006.01)
*E21B 23/03* (2006.01)

(52) U.S. Cl.
CPC ..... *E21B 41/0035* (2013.01); *E21B 23/03* (2013.01)

(58) Field of Classification Search
CPC ..... E21B 41/0035; E21B 23/03; E21B 19/22
See application file for complete search history.

(56) References Cited

U.S. PATENT DOCUMENTS 2,020,471 A * 11/1935 Layne ..... E21B 7/061 166/117.6
6,019,173 A * 2/2000 Saurer ..... E21B 23/06 166/117.6
6,206,111 B1 3/2001 Nistor
6,401,821 B1 6/2002 Kennedy et al.
7,717,185 B2 * 5/2010 Anderson ..... E21B 34/102 166/332.8
2002/0066577 A1 * 6/2002 Dewey ..... E21B 33/12 166/117.6
2012/0138301 A1 6/2012 Assal et al.
2016/0305215 A1 * 10/2016 Harris ..... E21B 33/1291
2018/0187519 A1 * 7/2018 Rodriguez ..... E21B 47/07
2018/0252075 A1 * 9/2018 Dietz ..... E21B 41/0035
2018/0283140 A1 10/2018 Steele
2019/0085661 A1 3/2019 Dancer
2024/0117713 A1 * 4/2024 Larsen ..... E21B 7/061

OTHER PUBLICATIONS

International Search Report and Written Opinion mailed Nov. 27, 2025 in PCT/US2025/040392.

* cited by examiner

*Primary Examiner* — Theodore N Yao
(74) *Attorney, Agent, or Firm* — The Hilton Firm PLLC

(57) ABSTRACT

Collapsable exit whipstocks and methods of using the same. An example collapsible exit whipstock has a lateral isolation sleeve having a body comprising a first terminal end and a second terminal end. The body engages with an interior surface of a completion system and has a throughbore running having a diameter. The collapsable exit whipstock has a whipstock with a coupling end that is coupled to the first terminal end of the lateral isolation sleeve and a tapered end opposite of the coupling end. The whipstock has slots opening at the tapered end and spaced along the longitudinal axis of the whipstock. Fingers are disposed between the slots and are configured to be pressed together such that the length of the whipstock that comprises the slots collapses radially inwards thereby reducing the throughbore diameter of the whipstock.

20 Claims, 7 Drawing Sheets

COLLAPSABLE COLLET EXIT WHIPSTOCK

TECHNICAL FIELD

The present disclosure relates generally to wellbore operations, and more particularly, to the use of a collapsable exit whipstock to provide access to a lateral wellbore without removing a lateral isolation sleeve.

BACKGROUND

In a multilateral well, a lateral wellbore extends from the main wellbore. Accessing the lateral wellbore from the main wellbore to perform a lateral wellbore operation may require a guide, such as a whipstock, to guide a wellbore tool or conduit into the lateral wellbore. To install the whipstock, existing tools such as isolation sleeves must be removed. The removal of these existing tools requires a separate intervention that must be completed before installation of the whipstock. Likewise, the tools cannot be reinstalled until the removal of the whipstock which also requires a separate intervention. Each required wellbore intervention requires time to complete and increases operational expenses.

Performing a lateral wellbore operation is an important part of operating a multilateral wellbore. The present disclosure provides a collapsible exit whipstock to improve multilateral wellbore operations.

BRIEF DESCRIPTION OF THE DRAWINGS

Illustrative examples of the present disclosure are described in detail below with reference to the attached drawing figures, which are incorporated by reference herein, and wherein.

Figure 1:
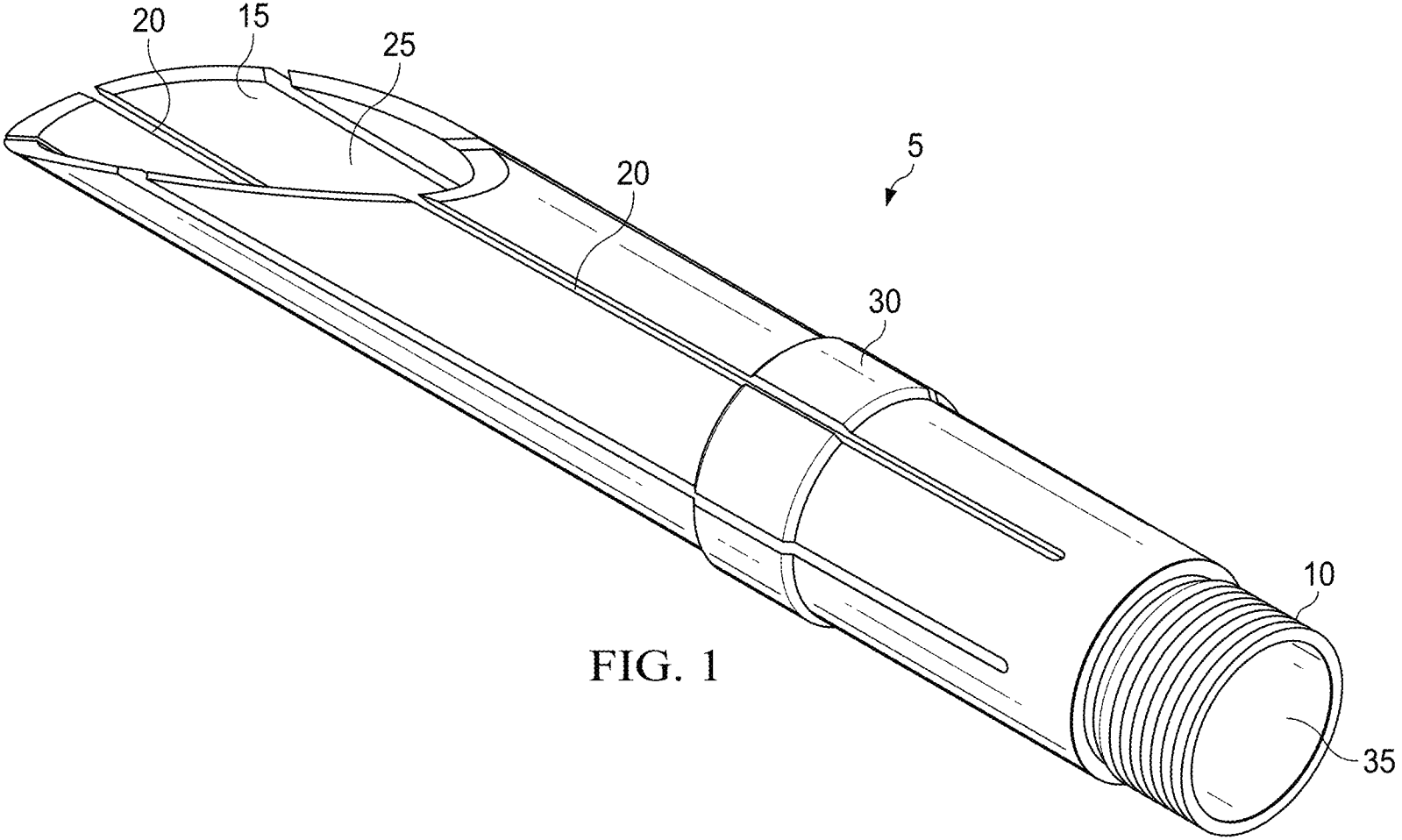
FIG. 1 is a perspective drawing of the whipstock portion of a collapsable exit whipstock in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of a collapsable exit whipstock to provide access to a lateral wellbore without removing a lateral isolation sleeve.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms "uphole" and "downhole" may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The terms "upstream" and "downstream" may be used to refer to the location of various components relative to one another in regards to the flow of a sample through said components. For example, a first component described as upstream from a second component will encounter a sample before the downstream second component encounters the sample. Similarly, a first component described as being downstream from a second component will encounter the sample after the upstream second component encounters the sample.

The present disclosure relates generally to wellbore operations, and more particularly, to the use of a collapsable exit whipstock to provide access to a lateral wellbore without removing a lateral isolation sleeve. Advantageously, the collapsable exit whipstock may be used to reduce the number of interventions needed to perform a lateral wellbore operation. The collapsable exit whipstock comprises a lateral isolation sleeve and a whipstock. The lateral isolation sleeve aligns with a lateral window in a completion system and allows for isolating fluid flow from the lateral wellbore when adjacent to the lateral window. The whipstock has a plurality of slots opening at its tapered end, which are spaced along the longitudinal axis of the whipstock for a portion of the length of the whipstock. The whipstock additionally comprises fingers, which are the portions of the whipstock disposed between the slots. The collapsable exit whipstock may be moved within the completion system. When a lateral wellbore operation is needed, the collapsable exit whipstock may be pushed downhole until the whipstock portion is aligned with the completion system lateral window. Advantageously, the fingers of the whipstock are pressed together such that the length of the whipstock that comprises the slots is collapsed radially inwards thereby reducing the throughbore diameter of the whipstock. This collapse and reduction in the throughbore diameter of the whipstock occurs when the collapsable exit whipstock shifts downhole for performing the multilateral wellbore operation. As a further advantage, upon completion of the multilateral wellbore operation, the entirety of the collapsable exit whipstock may be shifted back to its original position and the collapsed portion of the whipstock will expand to its original throughbore diameter. As such, separate interventions to remove the whipstock or isolation sleeve are not needed in order to perform the lateral wellbore operation.

Figure 2:
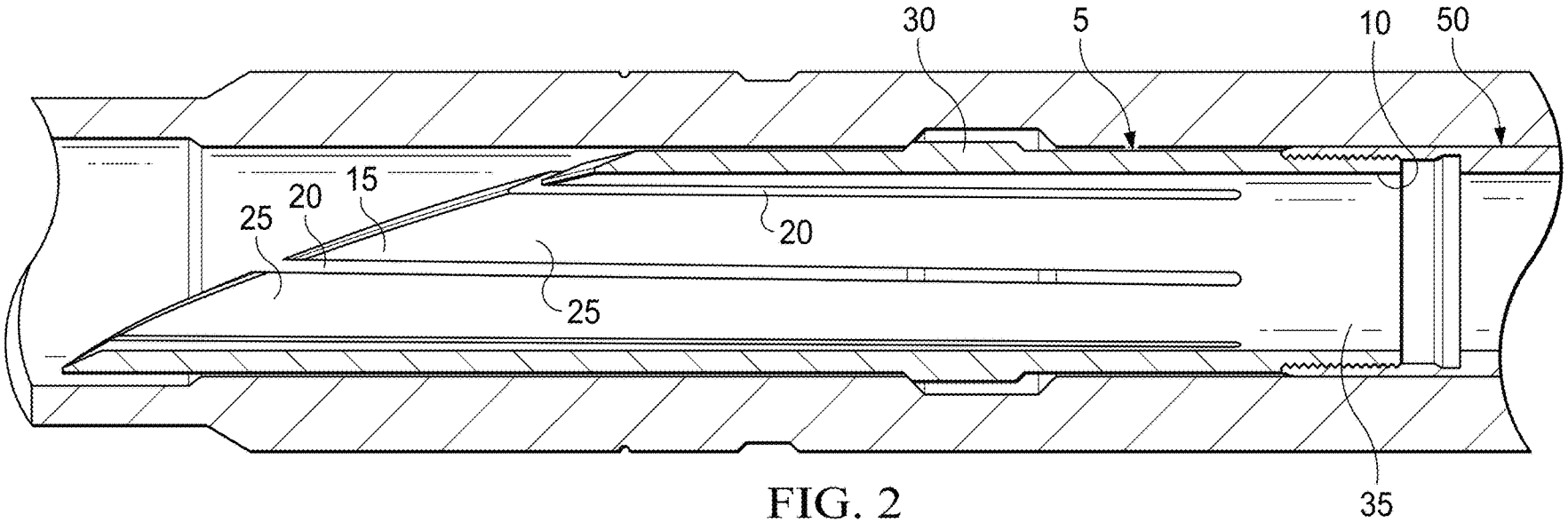
FIG. 2 is a cross-section of the whipstock of FIG. 1 as it is coupled to a lateral isolation sleeve in accordance with one or more examples described herein.

FIG. 1 is a perspective drawing of the whipstock 5 portion of the collapsable exit whipstock, which is illustrated in its entirety below. The whipstock 5 has a coupling end 10 that is used to couple the whipstock 5 to a terminal end of the lateral isolation sleeve (illustrated in FIG. 2). The whipstock 5 also comprises a tapered end 15 opposite of the coupling end 10. Generally, the tapered end 15 is a wedge that is tapered at an incline to form a guide for guiding a wellbore tool and/or conduit into a lateral wellbore. The whipstock 5 has a plurality of slots 20 which open at the tapered end 15 and are spaced along the longitudinal axis of the whipstock 5 for a portion of the length of the whipstock 5. The portions of the whipstock 5 disposed between the slots 20 are the fingers 25. The exterior of the whipstock 5 comprises a profile 30 which extends radially outward from the exterior surface of the whipstock 5. The profile 30 may be any shape and size sufficient for engaging with a corresponding profile on the interior surface of the completion system, as illustrated in FIG. 2 below. The whipstock 5 has a throughbore 35 with a diameter that is the same as the diameter of the body of the lateral isolation sleeve. When a lateral wellbore operation is to be performed, the entire collapsible exit whipstock is pushed downhole until the whipstock 5 aligns with the lateral window of the completion system. In this configuration, the whipstock 5 may guide a wellbore tool and/or conduit into the lateral wellbore from the main wellbore. As the whipstock 5 is pushed downhole, the extending profile 30 disengages from the corresponding profile of the completion system and as the disengaged extending profile 30 is pushed into another portion of the completion system having a narrower throughbore, the fingers 25 are pressed together such that the length of the whipstock 5 that comprises the slots 20 collapses radially inwards. This collapse reduces the throughbore diameter 35 of the whipstock 5 to be narrower than the inner diameter of the coupled lateral isolation sleeve.

It should be clearly understood that the example collapsable exit whipstock illustrated by FIG. 1 is merely a general application of the principles of this disclosure in practice, and a wide variety of other examples are possible. Therefore, the scope of this disclosure is not limited in any manner to the details of FIG. 1 as described herein.

FIG. 2 is a cross-section of the whipstock 5 of FIG. 1 as it is coupled to the lateral isolation sleeve 50. In the illustration, the lateral isolation sleeve 50 comprises a terminal end 55 on one side or end of its body. The terminal end 55 of the lateral isolation sleeve 50 couples to the whipstock 5 to produce the collapsable exit whipstock, which is illustrated below. The collapsable exit whipstock, comprising the coupled whipstock 5 and lateral isolation sleeve 50, may move from a first location in the completion system to a second location in the completion system. When a lateral wellbore operation is not needed, the lateral isolation sleeve 50 will be in the first location which is aligned with the lateral window in the surrounding completion system. In this orientation, the lateral isolation sleeve 50 may isolate fluid flow from the adjacent lateral wellbore. When a lateral wellbore operation is needed, the collapsable exit whipstock will be shifted from the first location to the second location which will align the whipstock 5 with the lateral window in the surrounding completion system and allow for the guiding of a wellbore tool and/or conduit into the adjacent lateral wellbore.

It should be clearly understood that the example collapsable exit whipstock illustrated by FIG. 2 is merely a general application of the principles of this disclosure in practice, and a wide variety of other examples are possible. Therefore, the scope of this disclosure is not limited in any manner to the details of FIG. 2 as described herein.

Figure 3:
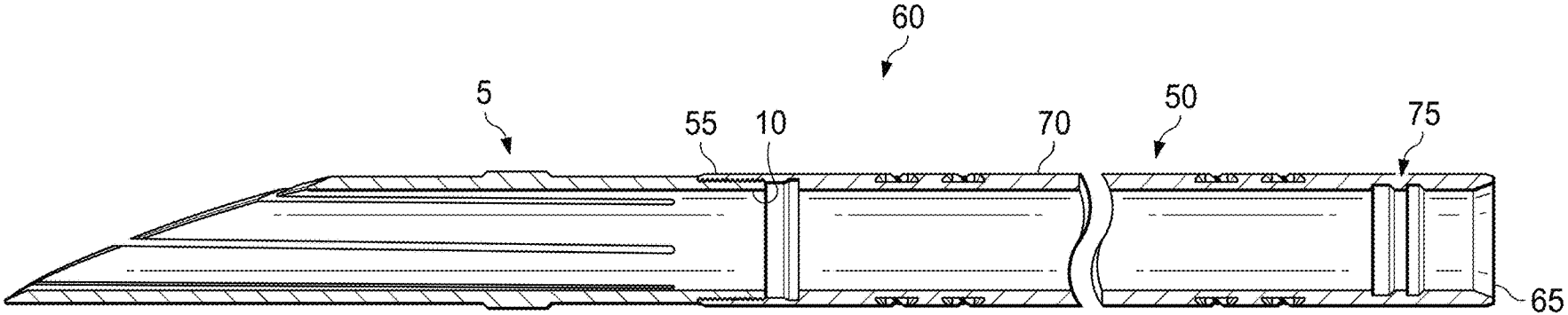
FIG. 3 is a perspective illustration of a collapsable exit whipstock comprising the whipstock from FIGS. 1 and 2 and the lateral isolation sleeve from FIG. 2 in accordance with one or more examples described herein.

FIG. 3 is a perspective illustration of a collapsable exit whipstock 60 comprising whipstock 5 from FIGS. 1 and 2 and lateral isolation sleeve 50 from FIG. 2. As illustrated, the coupling end 10 of whipstock 5 is coupled to the terminal end 55 of the lateral isolation sleeve 50. The lateral isolation sleeve 50 comprises a second terminal end 65 on the opposing side of its body 70. Proximate to the second terminal end 65 is an extending profile or protrusion 75 which is used to stop downward movement of the collapsable exit whipstock 5 at a specific point when it is shifted downhole so as to align the whipstock 5 with the lateral window of the completion system.

It should be clearly understood that the example collapsable exit whipstock illustrated by FIG. 3 is merely a general application of the principles of this disclosure in practice, and a wide variety of other examples are possible. Therefore, the scope of this disclosure is not limited in any manner to the details of FIG. 3 as described herein.

Figure 4:
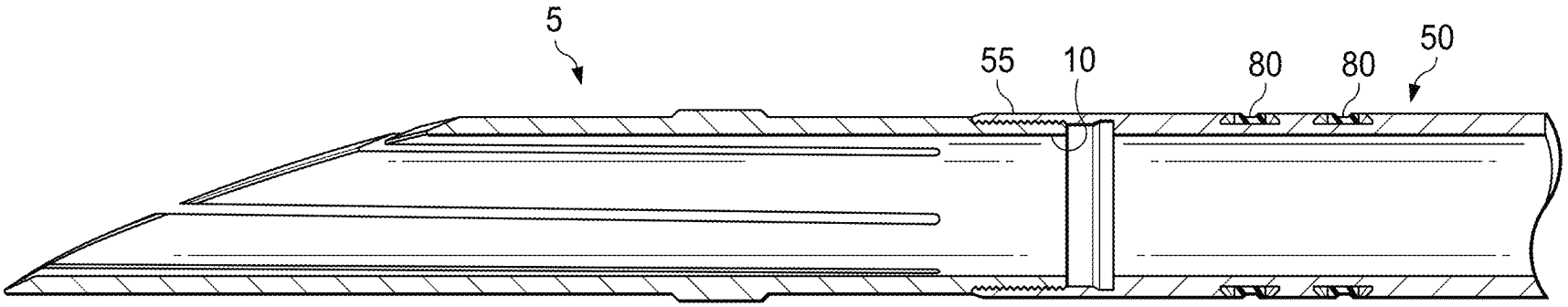
FIG. 4 is a cross-section illustration of the whipstock from FIGS. 1-3 as coupled to the lateral isolation sleeve from FIGS. 2 and 3 in accordance with one or more examples described herein.

FIG. 4 is a cross-section illustration of whipstock 5 from FIGS. 1-3 as coupled to lateral isolation sleeve 50 from FIGS. 2 and 3. As illustrated, the coupling end 10 of whipstock 5 is coupled to terminal end 55 of the lateral isolation sleeve 50. Sealing elements 80 are illustrated as disposed on the exterior of the body 70 of the lateral isolation sleeve 50 and are proximate to the first terminal end 55. Although two sealing elements 80 are illustrated, one sealing element 80 or more than two sealing elements 80 may be used as desired. Additional sealing elements 80 are analogously located proximate to the second terminal end 65 (as seen in FIG. 3).

It should be clearly understood that the example collapsable exit whipstock illustrated by FIG. 4 is merely a general application of the principles of this disclosure in practice, and a wide variety of other examples are possible. Therefore, the scope of this disclosure is not limited in any manner to the details of FIG. 4 as described herein.

Figure 5:
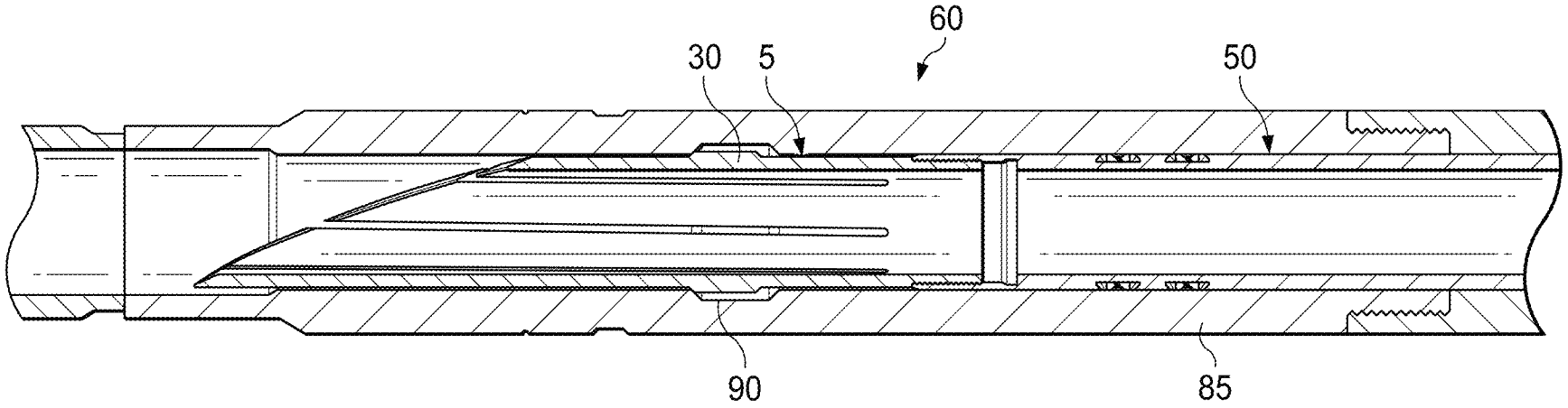
FIG. 5 is a cross-section illustration of a collapsable exit whipstock when positioned in a completion system in accordance with one or more examples described herein.

FIG. 5 is a cross-section illustration of a collapsable exit whipstock 60 when positioned in a completion system 85. When not used to perform a lateral wellbore operation, the collapsable exit whipstock 60 is installed in the completion system 85 to align the extending profile 30 of the whipstock 5 with the corresponding profile 90 of the interior surface of the completion system 85. The corresponding profile 90 is a profile that is recessed into the interior surface to the interior surface of the completion system 85 and is shaped to allow the extending profile 30 to fit inside. In this orientation, the lateral isolation sleeve 50 will be aligned with the lateral window of the completion system 85 as shown in FIG. 6 below.

It should be clearly understood that the example collapsable exit whipstock illustrated by FIG. 5 is merely a general application of the principles of this disclosure in practice, and a wide variety of other examples are possible. Therefore, the scope of this disclosure is not limited in any manner to the details of FIG. 5 as described herein.

Figure 6:
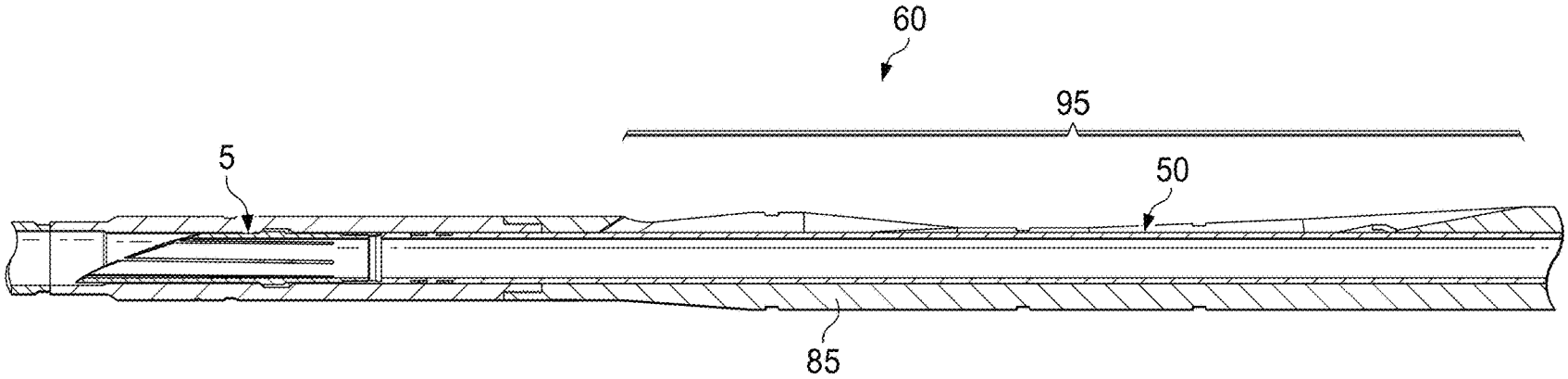
FIG. 6 is a cross-section illustration of a completion system having a collapsable exit whipstock installed within in accordance with one or more examples described herein.

FIG. 6 is a cross-section illustration of a completion system 85 having a collapsable exit whipstock 60 installed within. Completion system 85 comprises a lateral window 95 which is an area that is generally disposed over the opening of the lateral wellbore from the main wellbore. In this illustration, the lateral isolation sleeve 50 is disposed adjacent to the lateral window 95 and the whipstock 5 is positioned uphole of the lateral window 95. In this orientation, a lateral wellbore operation is not being performed and the lateral isolation sleeve 50 is used to isolate fluid flow from the lateral wellbore.

It should be clearly understood that the example collapsable exit whipstock illustrated by FIG. 6 is merely a general application of the principles of this disclosure in practice, and a wide variety of other examples are possible. Therefore, the scope of this disclosure is not limited in any manner to the details of FIG. 6 as described herein.

Figure 7:
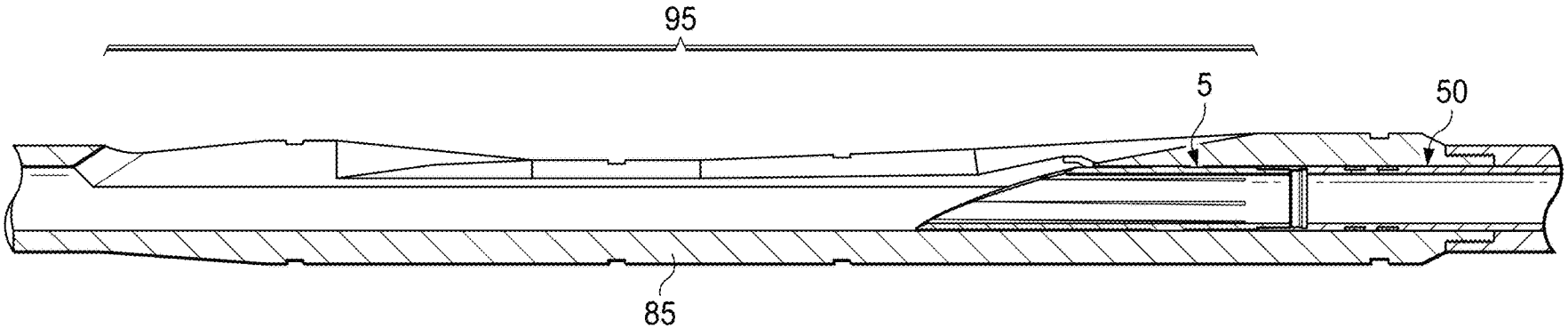
FIG. 7 is a cross-section illustration of a completion system having a collapsable exit whipstock installed within in accordance with one or more examples described herein.

FIG. 7 is a cross-section illustration of a completion system 85 having a collapsable exit whipstock 60 installed within. In the illustration of FIG. 7, the collapsable exit whipstock has been shifted downhole such that the whipstock 5 is aligned with the lateral window 95 and the lateral isolation sleeve 50 is now downhole of the lateral window 95. The slotted portion of the whipstock 5 is collapsed and the inner diameter of its throughbore is reduced from its default state as well as from the diameter of the throughbore of the lateral isolation sleeve 50. In this orientation, a lateral wellbore operation may be performed and a wellbore tool and/or conduit may be guided into the lateral wellbore by the whipstock 5.

It should be clearly understood that the example collapsable exit whipstock illustrated by FIG. 7 is merely a general application of the principles of this disclosure in practice, and a wide variety of other examples are possible. Therefore, the scope of this disclosure is not limited in any manner to the details of FIG. 7 as described herein.

Figure 8:
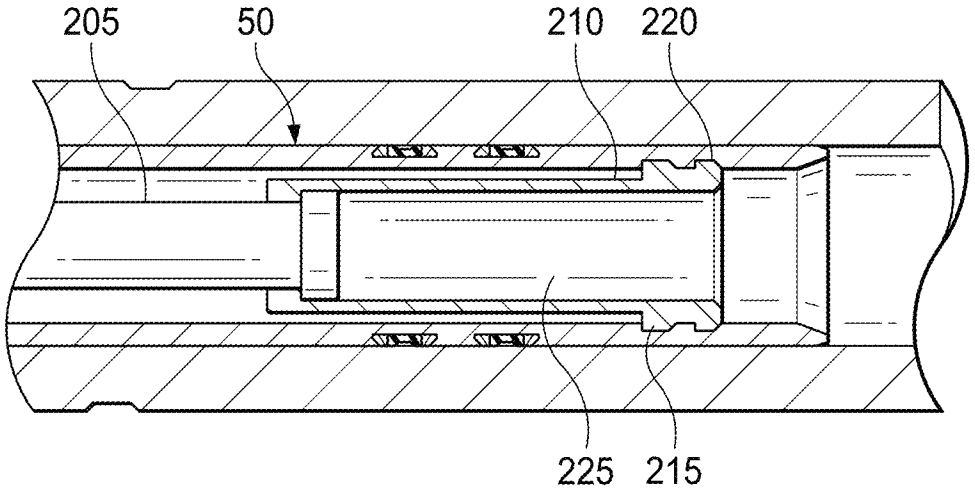
FIG. 8 is a cross-section of the isolation sleeve when coupled to a running tool and a shifting tool in accordance with one or more examples described herein.

FIG. 8 is a cross-section of the isolation sleeve 50 when coupled to a running tool 205 and a shifting tool 210. The shifting tool 210 comprises a shifting tool coupling 215. The running tool 205 and a shifting tool 210 are coupled tougher and run down the main wellbore through the whipstock throughbore (not illustrated) and into the throughbore 225 of the lateral isolation sleeve 50. The lateral isolation sleeve 50 comprises a locking coupling 220 which is illustrated as a recessed profile on the interior surface of the interior of the body of the lateral isolation sleeve 50. The shifting tool 210 locks to the locking coupling 220 of the isolation sleeve 50 with the shifting tool coupling 215. Once locked, the running tool 205 applies a force to the collapsable exit whipstock to move it from one location to another within the surrounding completion system. If the collapsable exit whipstock is to be moved downhole to perform a lateral wellbore operation, the running tool 205 moves the collapsable exit whipstock until the whipstock portion is aligned with the lateral window of the surrounding completion system. In this position, the running tool 205 will be disengaged from the shifting tool 210 and the shifting tool 210 will remain in the lateral isolation sleeve 50 until completion of the lateral wellbore operation. When the lateral wellbore operation is completed, the collapsable exit whipstock may be returned to its original position with the lateral isolation sleeve 50 aligned with the lateral window of the surrounding completion system. The running tool 205 (or a different tool) is reinserted into the lateral isolation sleeve 50 where it reengages with the shifting tool 210. The running tool 205 may then be used to apply sufficient force to pull the collapsable exit whipstock into its original position with the lateral isolation sleeve 50 aligned with the lateral window of the surrounding completion system. Once the collapsable exit whipstock has been returned and locked in place, the shifting tool coupling 215 is disengaged from the locking coupling 220 and the whole of the running tool 205 and the shifting tool 210 are pulled out of the collapsable exit whipstock.

It should be clearly understood that the example collapsable exit whipstock illustrated by FIG. 8 is merely a general application of the principles of this disclosure in practice, and a wide variety of other examples are possible. Therefore, the scope of this disclosure is not limited in any manner to the details of FIG. 8 as described herein.

Provided is a collapsable exit whipstock in accordance with the disclosure and the illustrated FIGs. An example collapsable exit whipstock comprises a lateral isolation sleeve having a body comprising a first terminal end and a second terminal end on opposing ends of the body. The body further comprises a first sealing element and a second sealing element on an exterior of the body. The body is configured to engage with an interior surface of a completion system. The body has a throughbore running along a longitudinal axis of the body and having a diameter. The collapsable exit whipstock further comprises a whipstock having a coupling end that is coupled to the first terminal end of the lateral isolation sleeve and a tapered end opposite of the coupling end. The tapered end is a wedge that is tapered at an incline. The whipstock has a plurality of slots opening at the tapered end and spaced along a longitudinal axis of the whipstock for a portion of the length of the whipstock. The whipstock comprises fingers disposed between the slots and a profile extending radially outward from an exterior surface of the whipstock which is configured to engage with a corresponding profile on the interior surface of the completion system. The whipstock has a throughbore having a diameter that is the same as the diameter of the body of the lateral isolation sleeve. The fingers are configured to be pressed together such that the length of the whipstock that comprises the slots collapses radially inwards thereby reducing the throughbore diameter of the whipstock. The radially inwards collapsing of the fingers is configured to occur when the profile on the exterior surface of the whipstock is disengaged from the corresponding profile on the interior surface of the completion system.

Additionally, or alternatively, the collapsable exit whipstock may include one or more of the following features individually or in combination. The lateral isolation sleeve may comprise a locking coupling on an interior surface of the body that is accessible from the throughbore of the body of the lateral isolation sleeve. The locking coupling may be configurable to couple to a running tool. The first sealing element may be located closer to the first terminal end of the lateral isolation sleeve than the second terminal end and the second sealing element may be located closer to the second terminal end of the lateral isolation sleeve than the first terminal end. The first and second sealing elements may be configured to seal against the interior surface of the completion system.

Provided are methods for using collapsable exit whipstock in accordance with the disclosure and the illustrated FIGs. An example method comprises installing the collapsable exit whipstock in a first location in a completion system. The collapsable exit whipstock comprises a lateral isolation sleeve having a body comprising a first terminal end and a second terminal end on opposing ends of the body. The body further comprises a first sealing element and a second sealing element on an exterior of the body. The body is configured to engage with an interior surface of a completion system. The body has a throughbore running along a longitudinal axis of the body and having a diameter. The collapsable exit whipstock further comprises a whipstock having a coupling end that is coupled to the first terminal end of the lateral isolation sleeve and a tapered end opposite of the coupling end. The tapered end is a wedge that is tapered at an incline. The whipstock has a plurality of slots opening at the tapered end and spaced along a longitudinal axis of the whipstock for a portion of the length of the whipstock. The whipstock comprises fingers disposed between the slots and a profile extending radially outward from an exterior surface of the whipstock which is engaged with a corresponding profile on the interior surface of the completion system when installed. The whipstock has a throughbore having a diameter that is the same as the diameter of the body of the lateral isolation sleeve. The method further comprises disengaging the profile on the exterior surface of the whipstock from the corresponding profile on the interior surface of the completion system, pressing the fingers together such that the length of the whipstock that comprises the slots is collapsed radially inwards thereby reducing the throughbore diameter of the whipstock, and shifting the collapsable exit whipstock from the first location in the completion system to a second location in the completion system.

Additionally, or alternatively, the method may include one or more of the following features individually or in combination. The lateral isolation sleeve may comprise a locking coupling on an interior surface of the body that is accessible from the throughbore of the body of the lateral isolation sleeve. The locking coupling may be configurable to couple to a running tool. The first sealing element may be located closer to the first terminal end of the lateral isolation sleeve than the second terminal end and the second sealing element may be located closer to the second terminal end of the lateral isolation sleeve than the first terminal end. The first and second sealing elements may be configured to seal against the interior surface of the completion system. The method may further comprise performing a lateral wellbore operation by accessing a lateral wellbore with a wellbore tool and/or conduit guided into the lateral wellbore by the collapsable exit whipstock while the collapsable exit whipstock in the second location. The lateral isolation sleeve may comprise a locking coupling on an interior surface of the body that is accessible from the throughbore of the whipstock and the body of the lateral isolation sleeve. The method may further comprise shifting the collapsable exit whipstock from the first location in the completion system to the second location in the completion system comprises accessing the locking coupling with a shifting tool having a corresponding shifting tool coupling, locking the shifting tool to the locking coupling with the shifting tool coupling, and pushing the collapsable exit whipstock to the second location with force applied through the locked shifting tool. The shifting tool may be coupled to a running tool and the shifting tool may remain in the collapsed exit whipstock while the running tool is removed to the surface prior to performing a wellbore operation. The method may further comprise reengaging the running tool with the shifting tool by reinserting the running tool through the whipstock and the body of the lateral isolation sleeve. The diameter of the whipstock is reduced when the running tool is reinserted. The method may further comprise pulling the collapsable exit whipstock from the second location in the completion system to the first location in the completion system with force applied from the reengaged running tool. The collapsed portion of the whipstock expands radially outwards when the collapsable exit whipstock is relocated to the first location. The method may further comprise removing the running tool and the shifting tool from the collapsable exit whipstock.

Provided are systems for performing a wellbore operation in a lateral wellbore in accordance with the disclosure and the illustrated FIGs. An example system comprises a collapsable exit whipstock comprising a lateral isolation sleeve having a body comprising a first terminal end and a second terminal end on opposing ends of the body. The body further comprises a first sealing element and a second sealing element on an exterior of the body. The body is configured to engage with an interior surface of a completion system. The body has a throughbore running along a longitudinal axis of the body and having a diameter. The collapsable exit whipstock further comprises a whipstock having a coupling end that is coupled to the first terminal end of the lateral isolation sleeve and a tapered end opposite of the coupling end. The tapered end is a wedge that is tapered at an incline. The whipstock has a plurality of slots opening at the tapered end and spaced along a longitudinal axis of the whipstock for a portion of the length of the whipstock. The whipstock comprises fingers disposed between the slots and a profile extending radially outward from an exterior surface of the whipstock which is configured to engage with a corresponding profile on the interior surface of the completion system. The whipstock has a throughbore having a diameter that is the same as the diameter of the body of the lateral isolation sleeve. The fingers are configured to be pressed together such that the length of the whipstock that comprises the slots is collapsed radially inwards thereby reducing the throughbore diameter of the whipstock. The radially inwards collapsing of the fingers is configured to occur when the profile on the exterior surface of the whipstock is disengaged from the corresponding profile on the interior surface of the completion system. The system further comprises the completion system having the collapsable exit whipstock installed therein.

Additionally, or alternatively, the system may include one or more of the following features individually or in combination. The completion system may comprise a window which opens to the lateral wellbore. The collapsable exit whipstock may isolate fluid flow from the lateral wellbore when the collapsable exit whipstock is disposed in a first location in the completion system. The collapsable exit whipstock may align the whipstock with the window of the completion system when the collapsable exit whipstock is disposed in a second location in the completion system; wherein the second location is a location where the profile on the exterior surface of the whipstock is disengaged from the corresponding profile on the interior surface of the completion system. The lateral isolation sleeve may comprise a locking coupling on an interior surface of the body that is accessible from the throughbore of the body of the lateral isolation sleeve. The locking coupling may be configurable to couple to a running tool. The first sealing element may be located closer to the first terminal end of the lateral isolation sleeve than the second terminal end and the second sealing element may be located closer to the second terminal end of the lateral isolation sleeve than the first terminal end. The first and second sealing elements may be configured to seal against the interior surface of the completion system. The completion system may comprise a window which opens to the lateral wellbore and the collapsable exit whipstock isolates fluid flow from the lateral wellbore when the collapsable exit whipstock is disposed in a first location in the completion system. The collapsable exit whipstock may align the whipstock with the window of the completion system when the collapsable exit whipstock is disposed in a second location in the completion system. The second location is a location where the profile on the exterior surface of the whipstock is disengaged from the corresponding profile on the interior surface of the completion system. The system may further comprising a shifting tool configured to access and lock to the interior of the isolation sleeve and to shift the collapsable exit whipstock from the first location to the second location. The system may further comprise a running tool coupled to the shifting tool and configured to be disengaged from the shifting tool prior to starting a lateral wellbore operation.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the apparatus and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A collapsable exit whipstock comprising:

a lateral isolation sleeve having a body comprising a first terminal end and a second terminal end on opposing ends of the body; wherein the body further comprises a first sealing element and a second sealing element on an exterior of the body; wherein the body is configured to engage with an interior surface of a completion system; wherein the body has a throughbore running along a longitudinal axis of the body and having a diameter; and a whipstock having a coupling end that is coupled to the first terminal end of the lateral isolation sleeve and a tapered end opposite of the coupling end; wherein the tapered end is a wedge that is tapered at an incline; wherein the whipstock has a plurality of slots opening at the tapered end and spaced along a longitudinal axis of the whipstock for a portion of a length of the whipstock; wherein the whipstock comprises fingers disposed between the slots; wherein the whipstock further comprises a profile extending radially outward from an exterior surface of the whipstock and which is configured to engage with a corresponding profile on the interior surface of the completion system; wherein the whipstock has a throughbore having a diameter that is the same as the throughbore diameter of the body of the lateral isolation sleeve; wherein the fingers are configured to be pressed together such that the length of the whipstock that comprises the slots is collapsed radially inwards thereby reducing the throughbore diameter of the whipstock; wherein the radially inwards collapsing of the fingers is configured to occur when the profile on the exterior surface of the whipstock is disengaged from the corresponding profile on the interior surface of the completion system.

2. The collapsable exit whipstock of claim 1, wherein the lateral isolation sleeve comprises a locking coupling on an interior surface of the body that is accessible from the throughbore of the body of the lateral isolation sleeve.

3. The collapsable exit whipstock of claim 2, wherein the locking coupling is configurable to couple to a running tool.

4. The collapsable exit whipstock of claim 1, wherein the first sealing element is located closer to the first terminal end of the lateral isolation sleeve than the second terminal end; wherein the second sealing element is located closer to the second terminal end of the lateral isolation sleeve than the first terminal end; wherein the first and second sealing elements are configured to seal against the interior surface of the completion system.

5. A method for using a collapsable exit whipstock, the method comprising:

installing the collapsable exit whipstock in a first location in a completion system: the collapsable exit whipstock comprising:

a lateral isolation sleeve having a body comprising a first terminal end and a second terminal end on opposing ends of the body; wherein the body further comprises a first sealing element and a second sealing element on an exterior of the body; wherein the body is configured to engage with an interior surface of a completion system; wherein the body has a throughbore running along a longitudinal axis of the body and having a diameter; and a whipstock having a coupling end that is coupled to the first terminal end of the lateral isolation sleeve and a tapered end opposite of the coupling end; wherein the tapered end is a wedge that is tapered at an incline; wherein the whipstock has a plurality of slots opening at the tapered end and spaced along a longitudinal axis of the whipstock for a portion of a length of the whipstock; wherein the whipstock comprises fingers disposed between the slots; wherein the whipstock further comprises a profile extending radially outward from an exterior surface of the whipstock and which is engaged with a corresponding profile on the interior surface of the completion system when installed; wherein the whipstock has a throughbore having a diameter that is the same as the throughbore diameter of the body of the lateral isolation sleeve;

disengaging the profile on the exterior surface of the whipstock from the corresponding profile on the interior surface of the completion system;

pressing the fingers together such that the length of the whipstock that comprises the slots is collapsed radially inwards thereby reducing the throughbore diameter of the whipstock; and shifting the collapsable exit whipstock from the first location in the completion system to a second location in the completion system.

6. The method of claim 5, further comprising performing a lateral wellbore operation by accessing a lateral wellbore with a wellbore tool and/or conduit guided into the lateral wellbore by the collapsable exit whipstock while the collapsable exit whipstock is in the second location.

7. The method of claim 5, wherein the lateral isolation sleeve comprises a locking coupling on an interior surface of the body that is accessible from the throughbore of the whipstock and the body of the lateral isolation sleeve.

8. The method of claim 7, wherein the shifting the collapsable exit whipstock from the first location in the completion system to the second location in the completion system comprises accessing the locking coupling with a shifting tool having a corresponding shifting tool coupling, locking the shifting tool to the locking coupling with the shifting tool coupling, and pushing the collapsable exit whipstock to the second location with force applied through the locked shifting tool.

9. The method of claim 8, wherein the shifting tool is coupled to a running tool and the shifting tool remains in the collapsed exit whipstock while the running tool is removed to the surface prior to performing a wellbore operation.

10. The method of claim 9, further comprising reengaging the running tool with the shifting tool by reinserting the running tool through the whipstock and the body of the lateral isolation sleeve; wherein the throughbore diameter of the whipstock is reduced when the running tool is reinserted.

11. The method of claim 10, further comprising pulling the collapsable exit whipstock from the second location in the completion system to the first location in the completion system with force applied from the reengaged running tool; wherein the collapsed portion of the whipstock expands radially outwards when the collapsable exit whipstock is relocated to the first location.

12. The method of claim 11, further comprising removing the running tool and the shifting tool from the collapsable exit whipstock.

13. The method of claim 5, wherein the first sealing element is located closer to the first terminal end of the lateral isolation sleeve than the second terminal end; wherein the second sealing element is located closer to the second terminal end of the lateral isolation sleeve than the first terminal end; wherein the first and second sealing elements are configured to seal against the interior surface of the completion system.

14. The method of claim 5, wherein the completion system comprises a window which opens to the lateral wellbore; wherein the collapsable exit whipstock isolates fluid flow from the lateral wellbore when the collapsable exit whipstock is disposed in the first location in the completion system.

15. The method of claim 14, wherein the collapsable exit whipstock aligns the whipstock with the window of the completion system when the collapsable exit whipstock is disposed in the second location in the completion system.

16. A system for performing a wellbore operation in a lateral wellbore, the system comprising:

a collapsable exit whipstock comprising:

a lateral isolation sleeve having a body comprising a first terminal end and a second terminal end on opposing ends of the body; wherein the body further comprises a first sealing element and a second sealing element on an exterior of the body; wherein the body is configured to engage with an interior surface of a completion system; wherein the body has a throughbore running along a longitudinal axis of the body and having a diameter; and a whipstock having a coupling end that is coupled to the first terminal end of the lateral isolation sleeve and a tapered end opposite of the coupling end; wherein the tapered end is a wedge that is tapered at an incline; wherein the whipstock has a plurality of slots opening at the tapered end and spaced along a longitudinal axis of the whipstock for a portion of a length of the whipstock; wherein the whipstock comprises fingers disposed between the slots; wherein the whipstock further comprises a profile extending radially outward from an exterior surface of the whipstock and which is configured to engage with a corresponding profile on the interior surface of the completion system; wherein the whipstock has a throughbore having a diameter that is the same as the throughbore diameter of the body of the lateral isolation sleeve; wherein the fingers are configured to be pressed together such that the length of the whipstock that comprises the slots is collapsed radially inwards thereby reducing the throughbore diameter of the whipstock; wherein the radially inwards collapsing of the fingers is configured to occur when the profile on the exterior surface of the whipstock is disengaged from the corresponding profile on the interior surface of the completion system, and the completion system having the collapsable exit whipstock installed therein.

17. The system of claim 16, wherein the completion system comprises a window which opens to the lateral wellbore; wherein the collapsable exit whipstock isolates fluid flow from the lateral wellbore when the collapsable exit whipstock is disposed in a first location in the completion system.

18. The system of claim 17, wherein the collapsable exit whipstock aligns the whipstock with the window of the completion system when the collapsable exit whipstock is disposed in a second location in the completion system; wherein the second location is a location where the profile on the exterior surface of the whipstock is disengaged from the corresponding profile on the interior surface of the completion system.

19. The system of claim 18, further comprising a shifting tool configured to access and lock to the interior of the isolation sleeve and to shift the collapsable exit whipstock from the first location to the second location.

20. The system of claim 19, further comprising a running tool coupled to the shifting tool and configured to be disengaged from the shifting tool prior to starting a lateral wellbore operation.

* * * * *